US008175311B2

(12) United States Patent
Aylward

(10) Patent No.: US 8,175,311 B2
(45) Date of Patent: May 8, 2012

(54) ELECTROACOUSTIC WAVEGUIDE TRANSDUCING

(76) Inventor: J. Richard Aylward, Ashland, MA (US)

( * ) Notice: Subject to any disclaimer, the term of this patent is extended or adjusted under 35 U.S.C. 154(b) by 981 days.

(21) Appl. No.: 12/163,467

(22) Filed: Jun. 27, 2008

(65) Prior Publication Data

US 2009/0003639 A1 Jan. 1, 2009

Related U.S. Application Data

(62) Division of application No. 09/753,167, filed on Jan. 2, 2001, now Pat. No. 7,426,280.

(51) Int. Cl.
*H04R 1/20* (2006.01)
*H04R 1/02* (2006.01)

(52) U.S. Cl. ..... 381/338; 381/337; 381/352

(58) Field of Classification Search ..... 381/338, 381/337, 345–349, 352, 71.5, 340, 342, 162; 181/152, 192, 144, 175, 182, 185, 186
See application file for complete search history.

(56) References Cited

U.S. PATENT DOCUMENTS

| | | | | |
|---|---|---|---|---|
| 4,509,184 | A | 4/1985 | Yanagawa | |
| 4,628,528 | A | 12/1986 | Bose et al. | |
| 4,933,982 | A | 6/1990 | Tanaka | |
| 5,588,063 | A | 12/1996 | Edgar | |
| 5,590,208 | A | 12/1996 | Koyano et al. | |
| 6,002,781 | A | 12/1999 | Takayama et al. | |
| 6,201,872 | B1 | 3/2001 | Hersh et al. | |
| 6,771,787 | B1 * | 8/2004 | Hoefler et al. | 381/338 |
| 7,379,556 | B2 * | 5/2008 | Maekawa et al. | 381/338 |
| 7,426,280 | B2 * | 9/2008 | Aylward | 381/338 |
| 7,623,670 | B2 * | 11/2009 | Hoefler et al. | 381/338 |

FOREIGN PATENT DOCUMENTS

| | | |
|---|---|---|
| EP | 0 744 880 | 11/1996 |
| FR | 2 770 734 | 5/1999 |
| JP | 02-302199 | 12/1990 |
| JP | 03 022796 | 1/1991 |
| JP | 2-11941 | 9/1991 |
| JP | 03-217199 | 9/1991 |
| JP | 08-331685 | 12/1996 |

OTHER PUBLICATIONS

CN Notice of Allowance dated Feb. 5, 2010 for Appl. No. 01145310.9.
EP Decision to Grant EP Appl. No. 01000755.7-1224/1221823.
Foreign communication from Japanese counterpart application dated Oct. 27, 2003 (12 pages).
English translation of foreign communication from Chinese counterpart application (7 pages).
Official Office Action from Japanese counterpart application No. 2001-399799, dated Oct. 3, 2003 (3 pages).

(Continued)

*Primary Examiner* — Xu Mei
(74) *Attorney, Agent, or Firm* — Bose Corporation

(57) ABSTRACT

An acoustic waveguide system, having source of acoustic radiation and a source of opposing acoustic radiation. An acoustic waveguide has an open end and an interior. A first acoustic driver having a first radiating surface and a second radiating surface is arranged and constructed so that the first radiating surface radiates sound waves into free air and the second radiating surface radiates sound waves into the acoustic waveguide so that sound waves are radiated at the open end. A source of opposing sound waves in the acoustic waveguide opposes a predetermined spectral component of the sound waves radiated into the acoustic waveguide to reduce the acoustic radiation of the predetermined spectral component from the acoustic waveguide.

6 Claims, 5 Drawing Sheets

OTHER PUBLICATIONS

Official Office Action from Chinese counterpart application No. 01145310.9, dated Feb. 10, 2006 with English Translation (31 pages).
Office Action in Application No. 1196/MUM/2001, dated Jun. 3, 2008.
Office Action in Application No. 01145310.9, dated Apr. 25, 2008.
Examination Report in EP Application No. 01000755.7, dated Aug. 29, 2008.
Reexamination Report of CN Appl. No. 01145310.9 dated Jul. 3, 2009.

* cited by examiner

ELECTROACOUSTIC WAVEGUIDE TRANSDUCING

FEDERALLY SPONSORED RESEARCH OR DEVELOPMENT

This application is a divisional of, and claims the benefit of priority under 35 U.S.C. 120 to, U.S. patent application Ser. No. 09/753,167 filed on Jan. 2, 2001 now U.S. Pat. No. 7,426,280. The disclosure of the prior application is considered part of and is incorporated by reference in the disclosure of this application.

CROSS-REFERENCE TO RELATED APPLICATIONS

Not applicable.

BACKGROUND OF THE INVENTION

For background, reference is made to U.S. Pat. No. 4,628,528, application Ser. No. 09/146,662 filed Sep. 3, 1998, now U.S. Pat. No. 6,771,787, for WAVEGUIDE ELECTROACOUSTICAL TRANSDUCING and the commercially available Bose Wave radio, Wave radio/CD and ACOUSTIC WAVE music systems incorporated herein by reference.

BRIEF SUMMARY OF THE INVENTION

It is an important aspect of the invention to provide improved electroacoustic waveguide transducing.

According to the invention, an electroacoustic waveguide transducing system includes an acoustic waveguide having an open end and an interior. A first acoustic driver or electroacoustic transducer has a first radiating surface that radiates sound waves into free air and a second radiating surface that radiates sound waves into the acoustic waveguide so that sound waves are radiated through the open end into free air that would ordinarily oppose the radiation from the first surface at a dip frequency. There is a source of opposing sound waves in the acoustic waveguide for opposing the acoustic radiation of a predetermined spectral component corresponding to said dip frequency of said sound waves radiated into the acoustic waveguide to oppose the acoustic radiation of the predetermined spectral component from the acoustic waveguide so that the combined radiation into free air from the first radiated surface and the open end is free from appreciable reduction in radiation at the dip frequency.

In another aspect of the invention, the electroacoustic driver is positioned in the acoustic waveguide so that there is null at a null frequency.

In another aspect of the invention, there are a plurality of electroacoustic transducers. A first of the acoustic drivers is placed in the wall of the acoustic waveguide. The transducers are placed in the waveguide typically separated by half the effective acoustic waveguide wavelength.

In another aspect of the invention, there is an acoustic low-pass filter, coupling the electroacoustic transducer and the acoustic waveguide.

In still another aspect of the invention, a method for operating an acoustic waveguide having an open end and a closed end and a wall connecting the open end and the closed end, includes radiating acoustic energy into the acoustic waveguide and significantly attenuating acoustic radiation at the frequency at which the wavelength is equal to the effective wavelength of the acoustic waveguide.

Other features, objects, and advantages will become apparent from the following detailed description, which refers to the following drawing in which:

DETAILED DESCRIPTION

Figure 1:
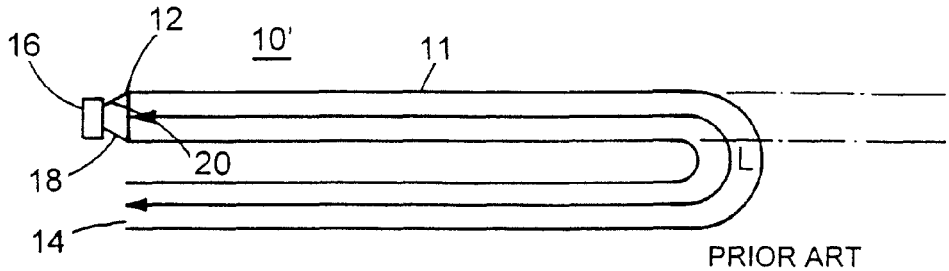
PRIOR ART FIG. 1
FIG. 1 is a diagrammatic cross section of a prior art electroacoustic waveguide transducer characterized by a dip frequency.

With reference now to the drawing and more particularly to FIG. 1, there is shown a prior art electroacoustical waveguide transducing system helpful in understanding acoustic waveguide transducing. Electroacoustical waveguide transducing system 10' includes an acoustic waveguide 11 that has a terminal end 12 and an open end 14. Mounted in the waveguide, at terminal end 12, is electroacoustical driver 16. When electroacoustical driver 12 radiates a sound wave, it radiates a front wave into free air surrounding the waveguide and a back wave into the waveguide. At some first frequency f, herein referred to as the "dip frequency," above the quarter-wave resonance frequency, the combined output of the waveguide and the output of the free air radiation have a phase and amplitude relation such that the combined output of the waveguide system has a "dip" or local minimum, herein referred to as an "acoustic dip." If the waveguide has a constant cross section, the dip frequency is approximately the frequency corresponding to a wave with a wavelength equal to the effective wavelength (including end effects) of the waveguide. If the waveguide does not have a constant cross section, the dip frequency may be determined by mathematical calculation, computer modeling, or empirically. In a constant cross section waveguide, a similar dip occurs when the sound waves have a frequency of a multiple of f, such as 2f, 3f, 4f, 5f (so that the wavelength L=2 wavelengths, 3 wavelengths, 4 wavelengths, 5 wavelengths and so on). In a waveguide having a varying cross section, a similar acoustic dip occurs at a frequency f and at multiples of frequency f, but the multiples may not be integer multiples of f, and the "dip" may not have the same steepness, width, or depth as the "dip" at frequency f. Typically, the dip at frequency f is the most significant.

Figure 2:
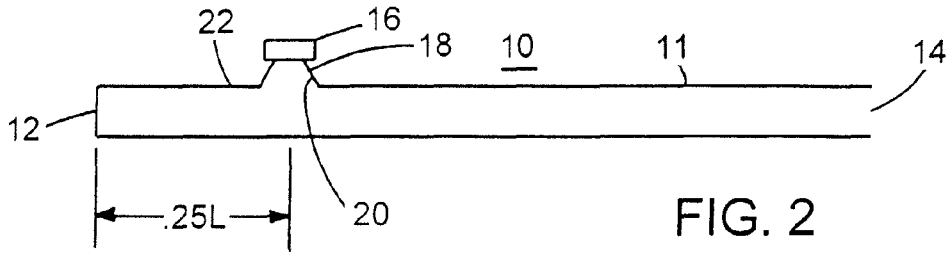
FIG. 2 is a diagrammatic cross section of an electroacoustical waveguide transducing system according to the invention.

Referring now to FIG. 2, there is shown an electroacoustical waveguide system 10 according to the invention. Waveguide system 10 includes an acoustic waveguide 11 that is a tubular structure that has a terminal end 12 and an open end 14. An "acoustic waveguide" as used herein, is similar to the tube or low loss acoustic transmission line disclosed in U.S. Pat. No. 4,628,528 or in the Bose Wave radio/CD. Terminal end 12 is terminated by an acoustically reflective surface. Mounted in a wall 22 of waveguide 11 is an acoustic energy source, in this case, an acoustic driver 16. Acoustic driver 16 has one radiating surface (in this case back side 18) of the acoustic driver facing free air and the other side (in this case front side 20) of the acoustic driver facing into acoustic waveguide 11. Acoustic driver 16 is mounted at a point such that the reflected sound wave in the waveguide is out of phase with the unreflected radiation in the waveguide from the acoustic driver and therefore the unreflected and reflected radiation oppose each other. As a result of the opposition, there is significantly reduced radiation from acoustic waveguide 11. Since there is significantly reduced radiation from the acoustic waveguide 11, the sound waves radiated into free air by the back side 16 of acoustic driver 16 are not opposed by radiation from waveguide 11, and the null at the dip frequency f at which the wavelength equal L (and at the even multiples of frequency f) is greatly reduced. In a waveguide of substantially constant cross section, if acoustic driver 16 is placed at a point 0.25 L, where L is the effective length of the waveguide including end effects, from the terminal end 12 of the waveguide, the reflected sound wave is out of phase with the unreflected radiation from the acoustic driver at the dip frequency.

Figure 3:
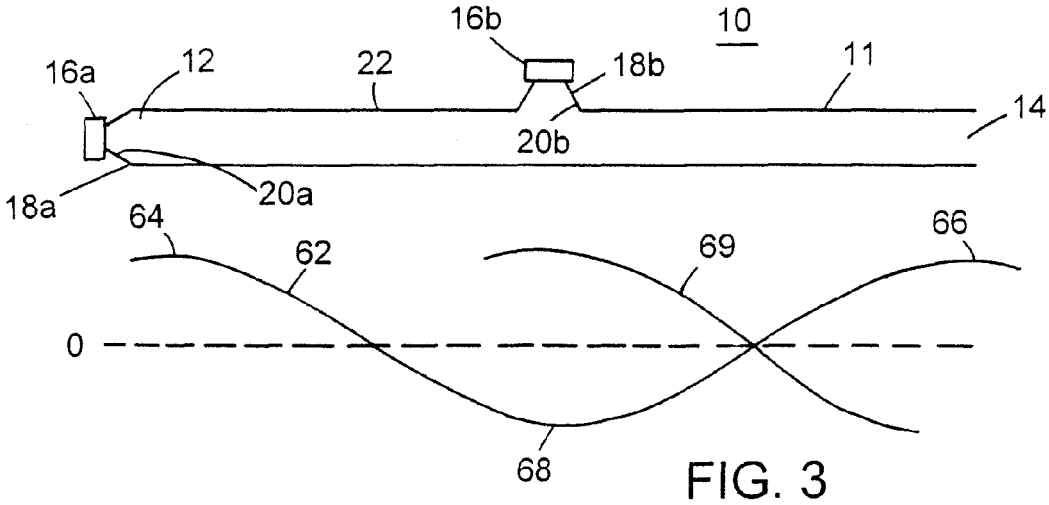
FIG. 3 is a diagrammatic cross section of second embodiment of the invention with a plot of pressure or volume velocity at points along the waveguide, for illustrating a feature of the invention.

Referring to FIG. 3, there is shown a second waveguide system according to the invention and a plot of pressure at points along the length of the waveguide. Waveguide system 10 includes an acoustic waveguide 11 that is a tubular structure that has a terminal end 12 and an open end 14. Acoustically coupled to the waveguide is an acoustic energy source, which, in the implementation of FIG. 3 includes two acoustic drivers 16*a* and 16*b*. First acoustic driver 16*a* is mounted in the terminal end 12, with one radiating surface (in this case back side 18*a*) of the first acoustic driver 16*a* facing free air and the other radiating surface (in this case front side 20*a*) of the first acoustic driver 16*a* facing into the acoustic waveguide 11. Second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into the acoustic waveguide 11. The second acoustic driver 16*b* is mounted at the acoustic midpoint (as defined below) of the waveguide. First and second acoustic drivers 16*a* and 16*b* are connected in phase to the same signal source (signal source and connections not shown).

When first acoustic driver 16*a* radiates a sound wave with a wavelength equal to L, the pressure and volume velocity resulting from the radiation of driver 16*a* in the waveguide vary as curve 62, with the pressure (or volume velocity) in-phase and of approximately equal amplitude 64, 66, at the front side 20*a* of driver 16*a* and at the open end 14 of the waveguide 11. At a point 68 between front side 20*a* of the driver and the open end 14, the pressure or volume velocity is equal to, and out of phase with, the pressure or volume velocity at points 64, 66. Point 68 will be referred to as the effective midpoint or the acoustic midpoint of the waveguide. Second acoustic driver 16*b* is connected in phase to the same signal source as first acoustic driver 16*a*. When first acoustic driver 16*a* radiates a sound wave with a wavelength equal to L, second acoustic driver 16*b* also radiates a sound wave with a wavelength equal to L, the pressure or volume velocity resulting from driver 16*b* varies as curve 68, in phase opposition to curve 62. The pressure or volume velocity waves from the two acoustic drivers therefore oppose each other, and there is significantly reduced radiation from the acoustic waveguide 11. Since there is significantly reduced radiation from the acoustic waveguide 11, the sound waves radiated into free air by the back side 18*a* of first acoustic driver 16*a* and the back side 18*b* of second acoustic driver 16*b* are not opposed by radiation from the waveguide.

If the waveguide has little or no variation in the cross-sectional area of the waveguide 11 as in FIG. 3, the effective midpoint of the waveguide is typically close to the geometric midpoint of the waveguide. In waveguide systems in which the waveguide does not having a uniform cross-sectional area, the effective midpoint of the waveguide may not be at the geometric midpoint of the waveguide, as described below in the discussion of FIG. 7. For waveguides in which the waveguide does not have a uniform cross section, the effective midpoint may be determined by mathematical calculation, by computer modeling, or empirically.

Figure 4:
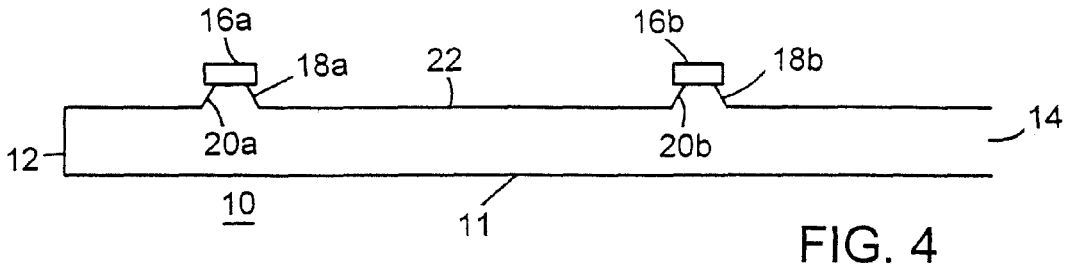
FIG. 4 is a diagrammatic cross section of a third embodiment of the invention.

Referring to FIG. 4, there is shown a third waveguide system according to the invention. Waveguide system 10 includes an acoustic waveguide 11 that is a tubular structure that has a terminal end 12 and an open end 14. Terminal end 12 is terminated by an acoustically reflective surface. Mounted in a wall 22 of the waveguide 11 is a first acoustic driver 16*a* at a position between the terminal end 12 and the effective midpoint of the waveguide, with one radiating surface (in this case back side 18*a*) of the first acoustic driver 16*a* facing free air and the other radiating surface (in this case front side 20*a*) of the first acoustic driver 16*a* facing into acoustic waveguide 11. Additionally, a second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into acoustic waveguide 11. The second acoustic driver 16*b* is mounted at a point between the first acoustic driver 16*a* and the open end 14 of the waveguide, and is electronically coupled in phase to the same audio signal source as first acoustic driver 16*a*. The mounting point of the second waveguide 16*b* is set such that radiation of second acoustic driver 16*b* opposes radiation from first acoustic driver 16*a* when acoustic drivers 16*a* and 16*b* radiate sound waves of wavelength equal to the effective length of waveguide 11. As a result of the opposition, there is significantly reduced radiation from acoustic waveguide 11. Since there is significantly reduced radiation from the acoustic waveguide 11, the sound waves radiated into free air by the back side 18*a* of first acoustic driver 16*a* and the back side 18*b* of second acoustic driver 16*b* are not opposed by radiation from the waveguide.

If the waveguide has a relatively uniform cross section, the distance between first acoustic driver 16*a* and second acoustic driver 16*b* will be about a 0.5 L, where L is the effective length of the waveguide. For waveguides with nonuniform cross-sectional areas, the distance between second acoustic driver 16*b* and first acoustic driver 16*a* can be determined by mathematical calculation, by computer modeling, or empirically.

Figure 5:
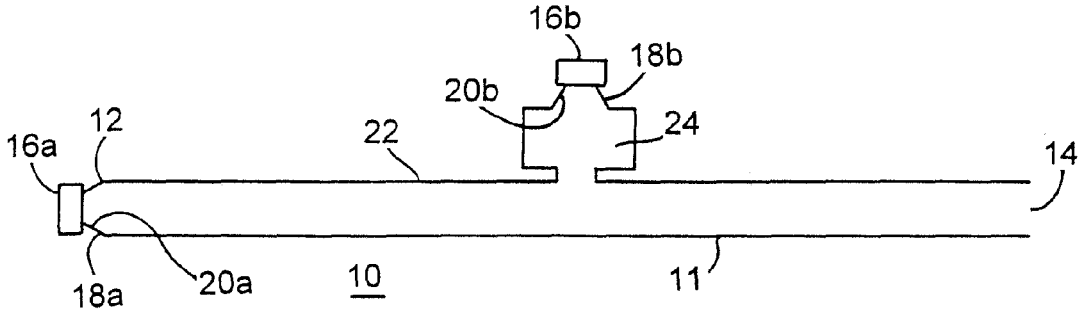
FIG. 5 is a diagrammatic cross section of a fourth embodiment of the invention.

Referring to FIG. 5, there is shown a fourth waveguide system according to the invention. Waveguide system 10 includes an acoustic waveguide 11 that is a tubular structure that has a terminal end 12 and an open end 14. Terminal end 12 is terminated by a first acoustic driver 16*a* mounted in the end, with one radiating surface (in this case back side 18*a*) of the first acoustic driver 16*a* facing free air and the other radiating surface (in this case front side 20*a*) of the first acoustic driver 16*a* facing into the acoustic waveguide 11. Additionally, a second acoustic driver 16*b* is mounted in a wall 22 of waveguide 11, with one radiating surface (in this case back side 18*b*) of the second acoustic driver 16*b* facing free air and the other radiating surface (in this case front side 20*b*) of acoustic driver acoustically coupled to the acoustic waveguide 11 by acoustic volume 24 at a point such that acoustic radiation from second driver 16*b* and acoustic radiation from first driver 16*a* oppose each other when first and second drivers 16*a* and 16*b* radiate sound waves with a wavelength equal to the effective length L or waveguide 11. First and second acoustic drivers 16*a* and 16*b* are connected in phase to the same signal source (signal source and connections not shown). As a result of the opposition, there is significantly reduced radiation from acoustic waveguide 11. Since there is significantly reduced radiation from acoustic waveguide 11, the sound waves radiated into free air by the back side 18*a* of first acoustic driver 16*a* and the back side 18*b* of second acoustic driver 16*b* of the acoustic driver are not opposed by radiation from the waveguide. Acoustic volume 24 acts as an acoustic low-pass filter so that the sound radiation from second acoustic driver 16*b* into acoustic waveguide 11 is significantly attenuated at higher frequencies. The embodiment of FIG. 5 damps output peaks at higher frequencies.

The principles of the embodiment of FIG. 5 can be implemented in the embodiment of FIG. 4 by coupling one of acoustic drivers 16*a* or 16*b* by an acoustic volume such as acoustic volume 24 of FIG. 5.

Figure 6:
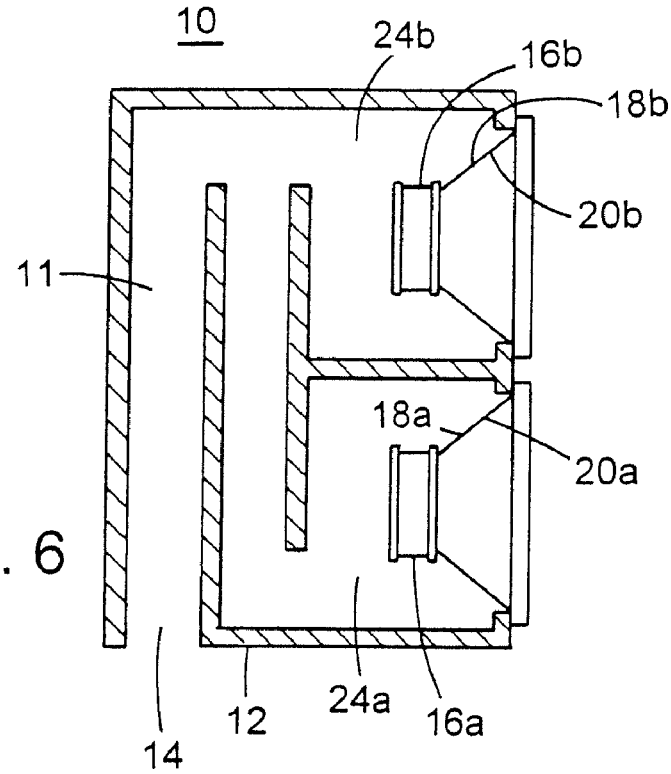
FIG. 6 is a diagrammatic cross section of a generalized form of a fifth embodiment of the invention.

Referring now to FIG. 6, there is shown another embodiment of the invention, combining the principles of the embodiments of FIGS. 3 and 5. Waveguide system 10 includes an acoustic waveguide 11 that is a tubular structure that has a terminal end 12 and an open end 14. Terminal end 12 is terminated by a first acoustic driver 16*a* mounted in the end, with one radiating surface (in this case front side 20*a*) of the first acoustic driver 16*a* facing free air and the other radiating surface (in this case back side 18*a*) of the first acoustic driver 16*a* acoustically coupled to the terminal end 12 of acoustic waveguide 11 by acoustic volume 24*a*. Additionally, a second acoustic driver 16*b* is mounted in a wall 22 of waveguide 11, with one radiating surface (in this case front side 20*b*) of the second acoustic driver 16*b* facing free air and the other radiating surface (in this case back side 18*b*) of the acoustic driver acoustically coupled to acoustic waveguide 11 by acoustic volume 24*b* at the effective midpoint of the waveguide. First and second acoustic drivers 16*a* and 16*b* are connected in phase to the same signal source (signal source and connections not shown). When first and second acoustic drivers 16*a* and 16*b* radiate a sound wave having a frequency equal to the opposition frequency, the sound wave radiated by second acoustic driver 16*b* and the sound wave radiated by acoustic driver 16*a* oppose each other. As a result of the opposition, there is significantly reduced radiation from acoustic waveguide 11. Since there is little radiation from the acoustic waveguide 11, the sound waves radiated into free air by the front side 20*a* of first acoustic driver 16*a* and the front side 20*b* of second acoustic driver 16*b* of the acoustic driver are not opposed by radiation from the waveguide, and the cancellation problem at the cancellation frequency f (and at the even multiples of frequency f) is greatly mitigated. Acoustic volumes 24*a* and 24*b* act as acoustic low-pass filters so that the sound radiation into the waveguide is significantly attenuated at higher frequencies, damping the high frequency output peaks.

The principles of the embodiment of FIG. 6 can be implemented in the embodiment of FIG. 4 by coupling acoustic drivers 16*a* and 16*b* to waveguide 11 by acoustic volumes such as the acoustic volumes 24*a* and 24*b* of FIG. 6.

Figure 7:
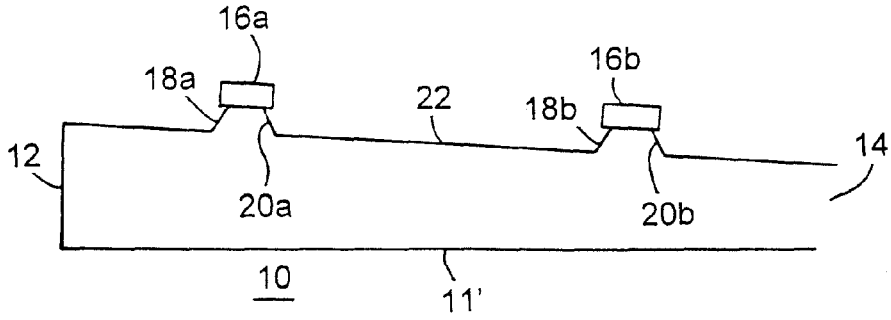
FIG. 7 is a diagrammatic cross section of a sixth embodiment of the invention.

Referring now to FIG. 7, there is shown another embodiment of the invention. Waveguide system 10 includes an acoustic waveguide 11' that is tapered as disclosed in U.S. patent application Ser. No. 09/146,662 and embodied in the Bose Wave radio/CD. Terminal end 12 is terminated by an acoustically reflective surface. Mounted in a wall 22 of waveguide 11 is a first acoustic driver 16*a* mounted at a position between the terminal end 12 and the effective midpoint of the waveguide. First acoustic driver 16*a* may also be mounted in terminal end 12. One radiating surface (in this case back side 18*a*) of the first acoustic driver 16*a* faces free air, and the other radiating surface (in this case front side 20*a*) of the first acoustic driver 16*a* faces into the acoustic waveguide 11. Additionally, a second acoustic driver 16*b* is mounted in a wall 22 of the waveguide 11, with one radiating surface (in this case back side 18*b*) of the second acoustic driver 16*b* facing free air and the other radiating surface (in this case front side 20*b*) of the acoustic driver facing into the acoustic waveguide 11. First and second acoustic drivers 16*a* and 16*b* are connected in phase to the same signal source (signal source and connections not shown). The second acoustic driver 16*b* is spaced by a distance such that when first and second acoustic drivers 16*a* and 16*b* radiate sound waves of a frequency equal to the dip frequency into waveguide 11, they oppose each other. As a result of the opposition, there is significantly reduced radiation from the acoustic waveguide 11. Since there is significantly reduced radiation from acoustic waveguide 11, the sound waves radiated into free air by the back side 18*a* of first acoustic driver 16*a* and the back side 18*b* of second acoustic driver 16*b* of the acoustic driver are not opposed by radiation from the waveguide.

In a tapered waveguide, or other waveguides with nonuniform cross sections, the effective midpoint (as defined in the discussion of FIG. 3) may differ from the geometric halfway point of the waveguide. For waveguides with nonuniform cross sections the effective midpoint may be determined by mathematical calculation, by computer simulation, or empirically.

Figure 8:
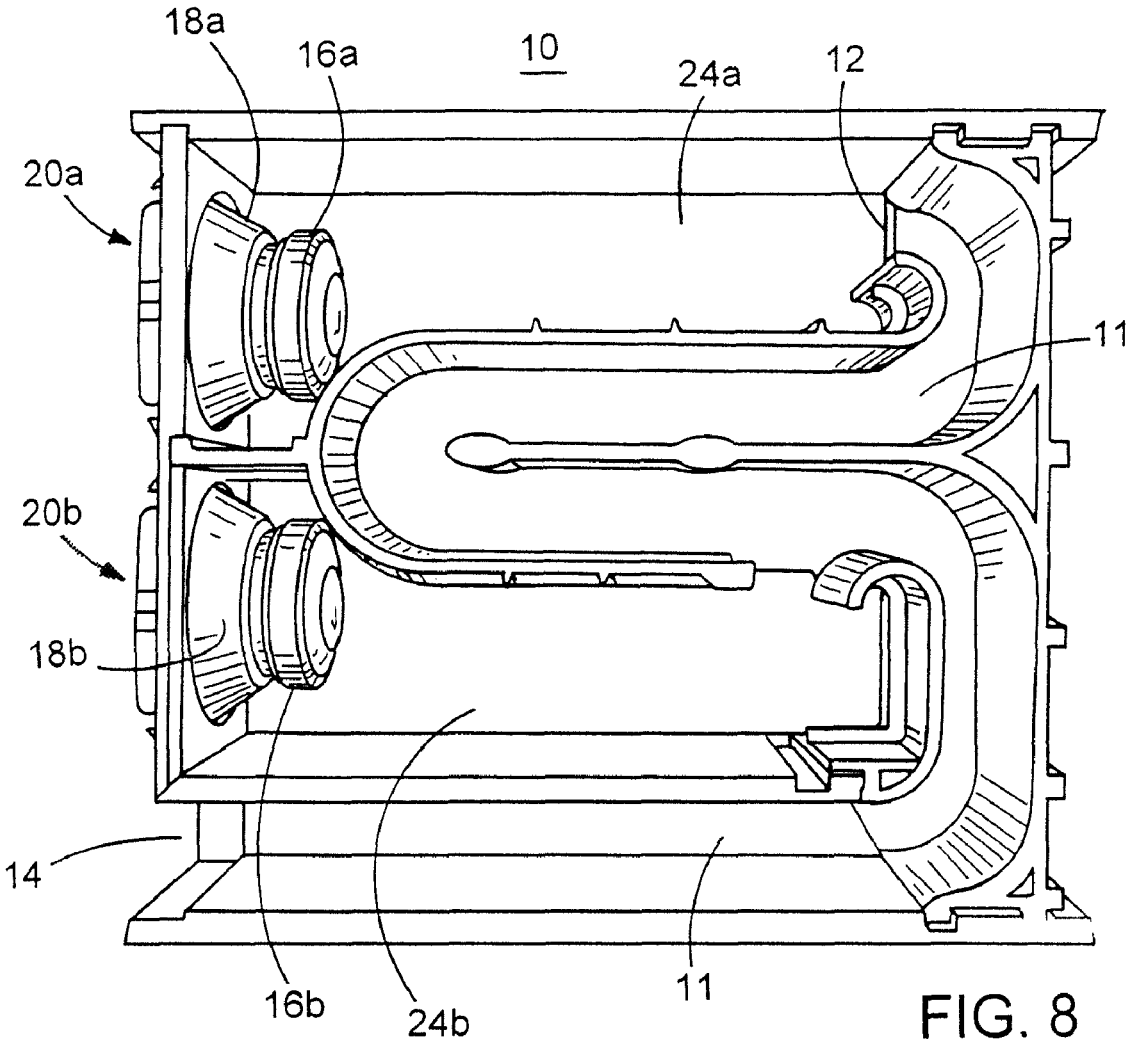
FIG. 8 is a wire frame drawing of an embodiment of the invention.

Referring now to FIG. 8, there is shown a cutaway perspective view of an exemplary electroacoustical waveguide system according to the invention. The waveguide system of FIG. 8 uses the implementation of FIG. 6, with the FIG. 8 implementation of the elements of FIG. 6 using common identifiers. In the implementation of FIG. 8, waveguide 11 has a substantially uniform cross sectional area of 12.9 square inches and a length of 25.38 inches. The acoustic volumes 24*a* and 24*b* have a volume of 447 cubic inches and 441 cubic inches, respectively, and the acoustic drivers are 5.25 inch 3.8 ohm drivers available commercially from Bose Corporation of Framingham, Mass.

Figure 9:
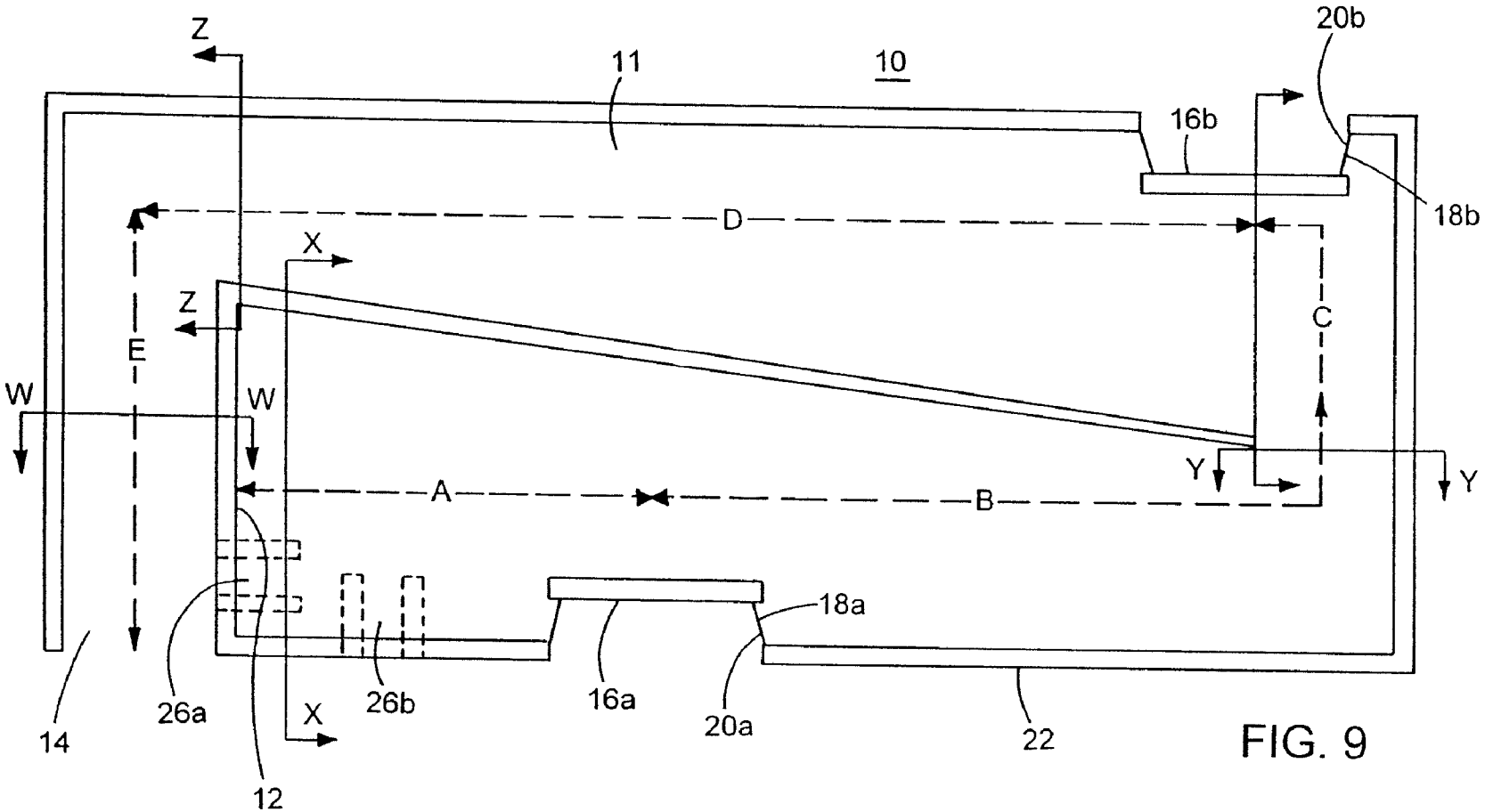
FIG. 9 is a diagrammatic cross section of a second embodiment of the invention.

Referring to FIG. 9, there is shown a cross section of another electroacoustical waveguide system according to the invention. In FIG. 9, identifiers refer to common elements of FIGS. 2-8. Waveguide 11 has two tapered sections, with a first section 11*a* having a cross section of 36.0 square inches at section X-X, 22.4 square inches at section Y-Y, 28.8 square inches at section Z-Z, 22.0 square inches at section W-W, and 38.5 square inches at section V-V. Length A is 10.2 inches, length B is 27.8 inches, length C is 4.5 inches, length D is 25.7 inches, and length E is 10.4 inches. Acoustic drivers 16*a* and 16*b* are 6.5 inch woofers available commercially from Bose Corporation of Framingham, Mass. To adjust acoustic parameters of the waveguide system, there may be an optional port

26*a* or 26*b* (dotted lines) and there may be acoustic absorbent material in the waveguide 11, such as near the terminal end 12 of the waveguide 11.

Figure 10:
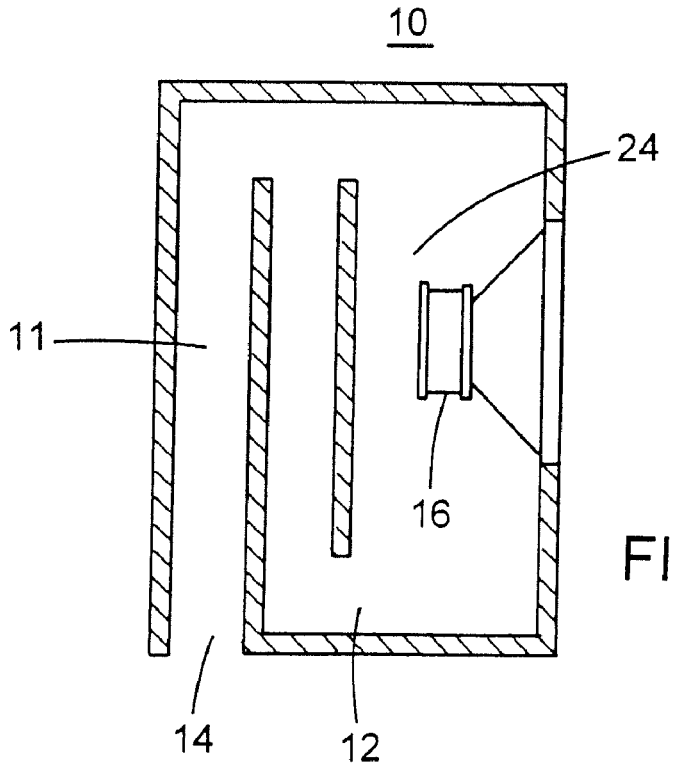
FIG. 10 is a diagrammatic cross section of another embodiment of the invention.

Referring to FIG. 10, there is shown another embodiment of the invention. The embodiment of FIG. 10 uses the topology of the embodiment of FIG. 8, but is constructed and arranged so that a single acoustic driver 16 performs the function of both acoustic drivers 16*a* and 16*b* of the embodiment of FIG. 6. If desired, the acoustic driver 16 can be replaced by more than one acoustic driver coupled to waveguide 11 by a common acoustic volume 24.

Other embodiments are within the claims.

What is claimed is:

1. An electroacoustic waveguide system, comprising:

an acoustic waveguide having an open end, a closed end, and an effective length;

an acoustic driver having a first radiating surface to radiate sound waves into free air and a second radiating surface to radiate sound waves into the acoustic waveguide so that sound waves are radiated at the open end into free air that would ordinarily oppose radiation from the first radiating surface at a dip frequency; and a source of opposing sound waves positioned in the acoustic waveguide so that there is an acoustic null at the open end at the dip frequency so that combined radiation into free air from the first radiating surface and the open end is free from appreciable reduction in radiation at the dip frequency;

wherein the acoustic driver is positioned at a distance substantially 0.25 L from the closed end of the waveguide, where L is an effective length of the waveguide.

2. An electroacoustic waveguide system in accordance with claim 1, wherein the closed end comprises a surface that is acoustically reflective at the dip frequency.

3. A method for operating an acoustic waveguide having an open end and a closed end and a wall connecting the open end and the closed end, comprising:

radiating acoustic energy into the acoustic waveguide; and significantly opposing acoustic radiation at a predetermined dip frequency;

wherein opposing the acoustic radiation comprises an acoustic driver for providing opposing acoustic radiation in the acoustic waveguide, and wherein providing the opposing acoustic radiation comprises reflecting radiated acoustic energy from the acoustic driver off an acoustically reflective surface inside the acoustic waveguide so that resulting reflected acoustic energy opposes the unreflected acoustic energy radiated into the waveguide by the acoustic driver.

4. An electroacoustic waveguide system comprising:

an acoustic waveguide having an open end, a closed end, and an effective midpoint;

a plurality of acoustic drivers;

an acoustic compliance acoustically coupling a first of the plurality of acoustic drivers and the acoustic waveguide;

wherein the acoustic waveguide has a substantially constant cross section;

wherein a first acoustic driver of the plurality of acoustic drivers is positioned at a distance substantially 0.25 L from the closed end, where L is an effective length of the acoustic waveguide, wherein a second acoustic driver of the plurality of acoustic drivers is positioned substantially 0.75 L from the closed end; and an acoustic compliance between the second acoustic driver and the acoustic waveguide;

wherein radiation from the first acoustic driver significantly opposes radiation from the second acoustic driver at a predetermined dip frequency.

5. An electroacoustic waveguide system comprising:

an acoustic waveguide having a substantially constant cross section; and a plurality of acoustic drivers placed in the acoustic waveguide so at least two of the acoustic drivers are substantially 0.5 L apart, where L is the effective length of the waveguide so that radiation from one of the acoustic drivers opposes radiation from another of the acoustic drivers at a predetermined dip frequency.

6. An electroacoustic waveguide system in accordance with claim 5, wherein a first acoustic driver of the plurality of acoustic drivers is placed at a position substantially 0.25 L from a closed end of the acoustic waveguide, and a second acoustic driver of the acoustic drivers is placed at a position substantially 0.75 L from the closed end, where L is the effective length of the waveguide.

* * * * *